United States Patent [19]

Cantlin

[11] Patent Number: 4,805,505

[45] Date of Patent: Feb. 21, 1989

[54] MULTI-STOP

[76] Inventor: John Cantlin, Deer Run Rd., Lincoln, Mass. 01773

[21] Appl. No.: 162,832

[22] Filed: Mar. 2, 1988

[51] Int. Cl.[4] ..... B27B 5/20; B27B 27/02

[52] U.S. Cl. ..... 83/467 R; 83/471.2; 83/477.2; 83/522; 269/236; 33/613

[58] Field of Search ..... 83/468, 467, 471.2, 83/471.3, 477.1, 522; 269/236; 33/180 R, 185 R, 613, 626

[56] References Cited

U.S. PATENT DOCUMENTS

| | | | |
|---|---|---|---|
| 2,962,063 | 11/1960 | Gussler | 83/522 X |
| 3,059,674 | 10/1962 | Boling | 83/471.2 X |
| 4,219,061 | 8/1980 | Duggins | 83/522 X |
| 4,256,000 | 3/1981 | Seidel | 83/468 |

*Primary Examiner*—Donald R. Schran

*Attorney, Agent, or Firm*—John E. Toupal; Harold G. Jarcho

[57] ABSTRACT

A wood working accessory including a vice with a first jaw having an engagement surface for engaging one surface of a fence or the like, a second jaw for engaging an opposite surface of the fence, a yoke joining the first and second jaws and adapted to extend over an edge of the fence extending between the opposite surfaces thereof, and an adjustment mechanism operable to produce relative movement between the first and second jaws in a given direction substantially perpendicular to the engagement surface so as to produce selective forcible engagement of the fence between the first and second jaws. Also included are a first stop retainer on the first jaw, and adapted to retain a stop member and guide movement thereof relative to the first jaw in a first direction substantially perpendicular to the given direction, and a second stop retainer on the first jaw and adpted to retain a stop member and guide movement thereof relative to the first jaw in a second direction substantially perpendicular to both the given direction and the first direction.

18 Claims, 2 Drawing Sheets

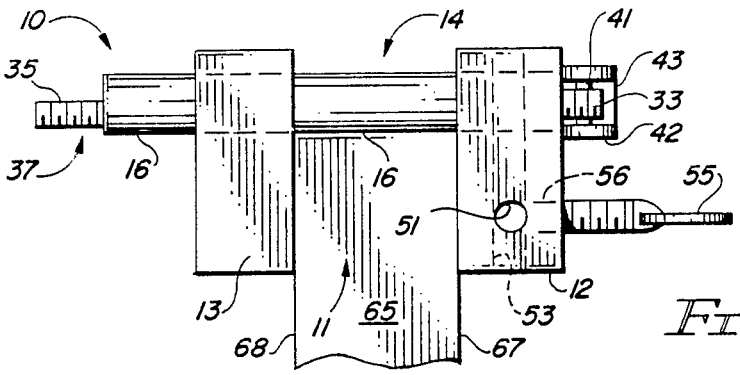
FIG. 4
FIG. 5
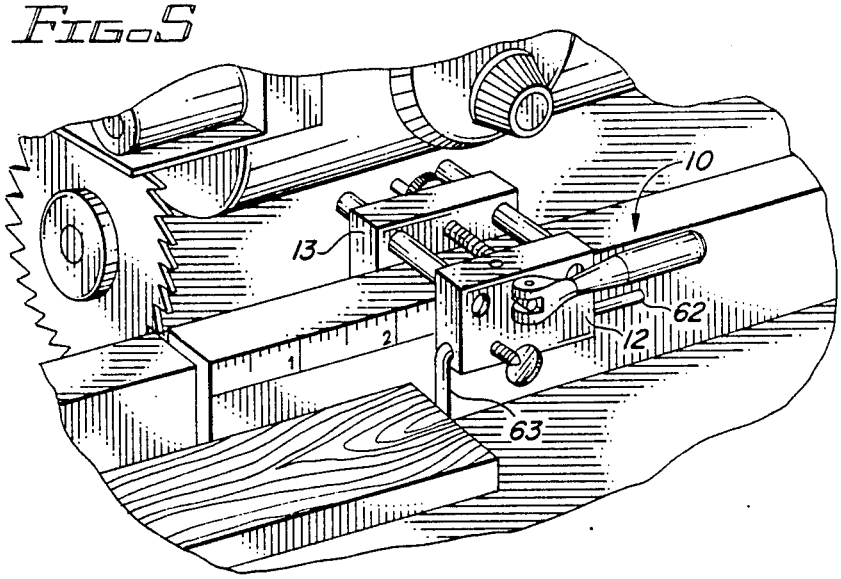
FIG. 6
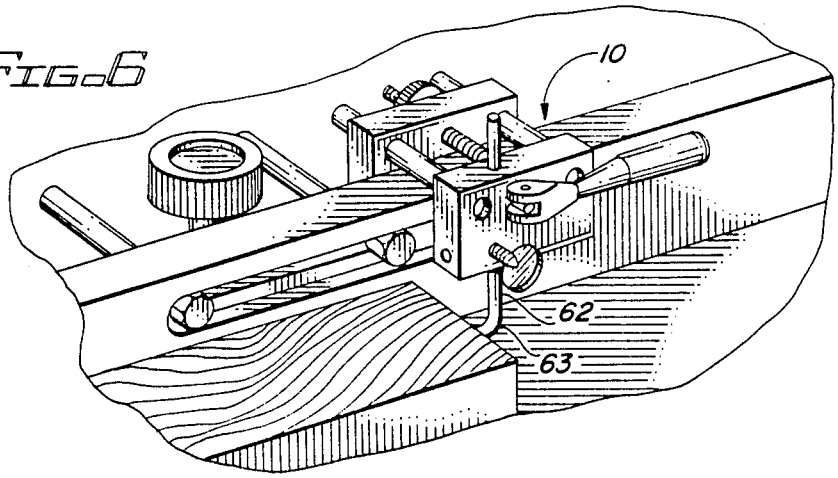

MULTI-STOP

BACKGROUND OF THE INVENTION

This invention relates generally to a power tool accessory and, more specifically to a work piece stop for use with wood working machines.

Devices used to stop a work piece at a specific positioning limit are well known. They are used extensively in wood working and also in the working of metals and other materials. The basic advantage of working to a stop is that one or more pieces can be very accurately positioned for cutting, bending, or other processing operations. Cutting several pieces which are all positioned to a stop produces a repeatable precision that would be most difficult to accomplish by layout, and cutting to a mark, if it could be duplicated at all.

Cutting to a stop is commonly done in production operations because of the precision and economy of repetitive cutting or forming operations, and many machines are equipped with adjustable or fixed stop devices. Such production stop devices generally are designed for specific production operations.

Cabinet makers, on the other hand, commonly clamp a block of wood (a stop block) onto a bench or other work base, such as a miter box, to assure that the work piece will be properly positioned. There are, however, inherent problems in clamping a stop block in place. For example: figuring out where to clamp the block takes time and may require cutting a special block, or looking for a suitable scrap to be used for the purpose; a clamp must be located that will be big enough to reach over the stop block and the fence or table or other base or guide that the stop block is to be clamped to; if the block is not positioned with care variations in the angle of the stop block may introduce errors in the position of the cut; if the stop block is not positioned away from certain adjacent surfaces a pocket may be created where sawdust or chips from the material being cut will build up and cause an error of increasing magnitude in successive work pieces; when pieces of a like nature are being made, but having a cut performed to a varying distance after a small number of pieces are processed, the adjustment of the stop block may be inordinately time consuming; and when pieces are being positioned on a radial arm saw or other similar machines, the clamp that holds the stop block may get in the way of the moving parts of the machine such as the saw handle or motor.

In an effort to overcome the above disadvantages, and others, a number of stop mechanisms have been developed for certain particular machines. However, such devices have for the most part been very limited in there application and have been relatively expensive. Examples of prior stop mechanisms are disclosed in U.S. Pat. Nos. 3,124,181 and 4,256,000.

The object of this invention, therefore, is to provide an improved, more versatile stop mechanism for use with a variety of power tools.

SUMMARY OF THE INVENTION

The invention is a wood working accessory including a vice with a first jaw having an engagement surface for engaging one surface of a fence or the like, a second jaw for engaging an opposite surface of the fence, a yoke joining the first and second jaws and adapted to extend over an edge of the fence extending between the opposite surfaces thereof, and an adjustment mechanism operable to produce relative movement between the first and second jaws in a given direction substantially perpendicular to the engagement surface so as to produce selective forcible engagement of the fence between the first and second jaws. Also included are a first stop retainer on the first jaw, and adapted to retain a stop member and guide movement thereof relative to the first jaw in a first direction substantially perpendicular to the given direction, and a second stop retainer on the first jaw and adapted to retain a stop member and guide movement thereof relative to the first jaw in a second direction substantially perpendicular to both the given direction and the first direction. The accessory can be used on most all machine tables or fences and, with appropriate stops, can provide regulation of position or movement of a work piece in two or more planes.

According to one feature of the invention, the accessory also includes a set mechanism selectively operable to prevent movement of a stop member in either of the first or second stop retainers. The set mechanism insures that a given stop member position can be retained.

According to another feature of the invention, the first stop retainer comprises a first hole extending through the first jaw and substantially parallel to the engagement surface, and the second stop retainer comprises a second hole extending through the first jaw and substantially parallel to the engagement surface. The retainer holes facilitate the use of the accessory with easily produced specific stop rods. In addition, during certain operations, the set mechanism can remain inactivated and a stop rod can experience either rotation or sliding movement within the retainer holes.

According to yet another feature of the invention, the first hole intersects the second hole and the set mechanism comprises a threaded opening in the first jaw and a set screw retained therein, the threaded opening extending substantially perpendicular to the engagement surface and intersecting both the first and second holes at the intersection thereof. This arrangement provides the desired stop sets in an extremely simple form.

According to other features of the invention, the yoke comprises first and second spaced apart slide rods each having one end fixed to the first jaw and a shank portion slidably received by openings in the second jaw; and the adjustment mechanism comprises a screw straddled by the slide rods and having one end fixed to the first jaw and a body portion extending through an aperture in the second jaw, and a nut received by an opposite end of the screw and movable into engagement with the second jaw so as to produce the movement thereof relative to the first jaw. This arrangement provides an extremely compact accessory that can be easily installed on fences of various size and which will not interfere with other portions of a machine.

According to a further feature of the invention, the screw extends slidably through an opening in the first jaw and the adjustment mechanism further comprises a handle with a cam portion fixed to the one end of the screw and engageable with a surface of the first jaw opposite to the engagement surface, the handle being operable to produce a predetermined limited degree of relative movement between the first and second jaws. The cam handle facilitates quick assembly or removal of the accessory.

DESCRIPTION OF THE DRAWINGS

These and other objects and features of the invention will become more apparent upon a perusal of the following description taken in conjunction with the accompanying drawings wherein:

FIG. 4 is a front view of the accessory as shown in FIG. 3;

FIG. 5 is a perspective view showing the accessory mounted on a fence; and

FIG. 6 is a perspective view showing the accessory mounted on a different fence.

DESCRIPTION OF THE PREFERRED EMBODIMENT

Figure 1:
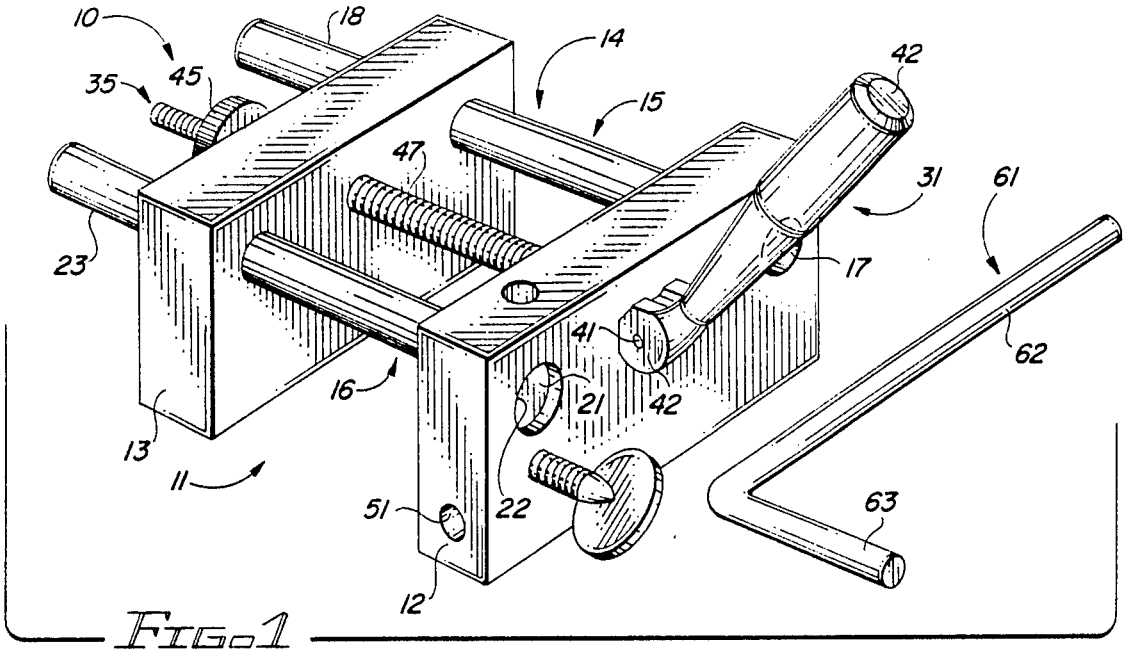
FIG. 1 is a perspective view of a wood working accessory according to the invention.

Referring now to FIGS. 1–4 there is shown a wood working accessory 10 in accordance with the invention. The accessory 10 includes a vice 11 having a first rectangularly shaped clamping jaw 12 and a second rectangularly shaped clamping jaw 13. Joining upper portions of the first and second clamping jaws 12, 13 is a yoke 14 formed by a first slide rod 15 and a second slide rod 16 parallel and spaced apart therefrom. One end 17 of the first slide rod 15 is fixed within an opening in the first jaw 12 and a shank portion 18 extends slidably through an opening 19 in the second jaw 13. Similarly, one end 21 of the second slide rod 16 is fixed within an opening 22 in the first jaw 12 while a shank portion 23 extends slidably through an opening 24 in the second jaw 13.

An additional component of the vice 11 is an adjustment mechanism 31 that includes an elongated screw 32 extending parallel to and straddled by the slide rods 15, 16. One end 33 of the screw 32 extends freely through an opening 34 in the first jaw 12 while a body portion 35 extends between the first and second jaws 12, 13 and freely through an aperture 36 in the second jaw 13. A pin 41 fixes the end 33 of the screw 32 to a bifurcated cam portion 42 of an operating handle 43. Operatively engaging the body portion 35 of the screw 32 is a nut 45 disposed on the side of the second jaw 13 opposite to the first jaw 12. A jaw opening spring 47 is disposed over the screw 32 and has ends that engage the jaws 12 and 13.

Other parts of the accessory 10 are a pair of stop retainer holes 51 and 53. The first stop retainer hole 51 extends horizontally and completely through the first jaw 13. Disposed substantially below the slide rods 15, 16, the first stop retainer hole 51 extends parallel to an inner engagement surface 52 of the first jaw 12. The second stop retainer hole 53 extends vertically and completely through the first jaw 12 also parallel to its engagement surface 52. Disposed between the screw 32 and the second slide rod 16, the second stop retainer hole 53 intersects the first stop retainer hole 51. Accommodating a set screw 55 is a threaded opening 56 in the first jaw 12 extending perpendicular to its engagement surface 52 and intersecting both the first stop retainer hole 51 and the second stop retainer hole 53.

A final component of the accessory 11 is an L-shaped stop rod 61 having an elongated portion 62 joined at one end to a transverse portion 63. The equal outer diameters of the stop rod portions 62 and 63 are such as to be slidably received by either the first stop retainer hole 51 or the second top retainer hole 53.

Figure 2:
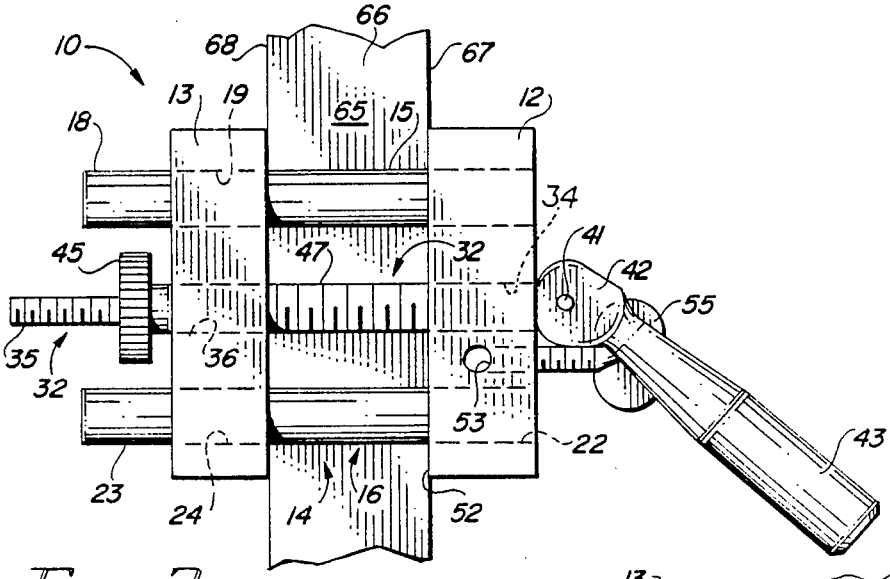
FIG. 2 is a top view of the accessory shown in FIG. 1 and with a cam handle in a released position.
Figure 3:
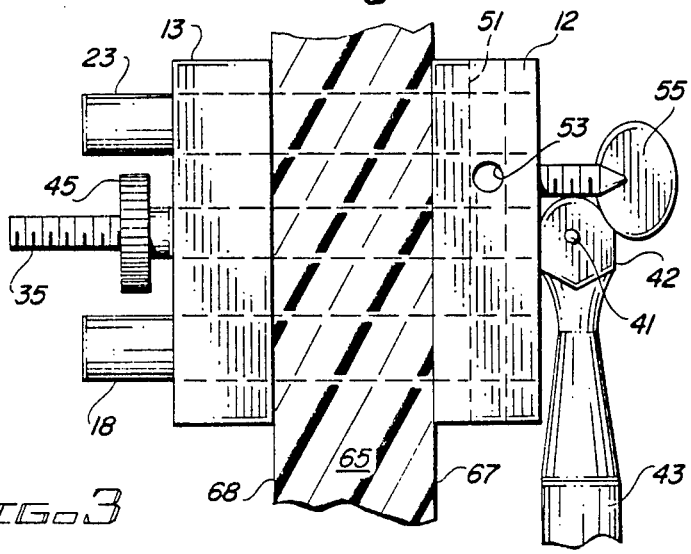
FIG. 3 is a bottom view of the accessory shown in FIGS. 1 and 2 but with the cam handle shown in an actuated position.

During typical use, the accessory 10 is mounted in a desired position on a fence 65 of a wood working tool as shown in FIGS. 2–4. The first and second jaws 12, 13 are positioned on opposite sides of the fence 65 with the yoke 14 engaging an upper edge 66 thereof. In the release position shown in FIG. 2, the leverage providing handle 43 is rotated to tighten the nut 45 while producing relative movement between the first and second jaws 12, 13 in a given direction substantially perpendicular to the engagement surface 52 of the first jaw 12. Tightening of the nut 45 is continued until a relatively loose engagement is created between the first and second jaws 12, 13 and respectively, opposite surfaces 67 and 68 of the fence 65. A secure forcible engagement between the fence 65 and the first and second jaws 12, 13 is obtained by moving the handle 43 into the operative position shown in FIG. 3. During that manipulation of the handle 43, engagement between the cam portion 42 and the outer surface of the first jaw 12 produces additional relative movement between the first and second jaws 12, 13 and induces tight engagement thereof with the opposite surfaces 67 and 68 of the fence 65.

Either before or after mounting of the vice 11, either the elongated portion 62 or the transverse portion 63 of the stop rod 61 is inserted into either the first stop retainer hole 51 or the second stop retainer hole 53. After being inserted into the first stop retainer hole 51, movement of the stop rod 61 is guided thereby in a horizontal direction parallel to the engagement surface 52. When a desired position is obtained with respect to the first jaw 12 further movement is restrained by moving the set screw 55 into engagement with the stop rod 61. Similarly, when inserted into the second stop retainer hole 53, movement of the stop rod 61 is guided thereby in a vertical direction parallel to the engagement surface 52 of the first jaw 12 and, after attainment of a desired relative position thereto, further movement of the stop rod 61 is prevented by moving of the set screw 55 into engagement therewith. Release of the vice 11 and subsequent mounting in a different desired position on the same fence or one of similar width merely requires use of the cam handle 43.

FIG. 5 illustrates use of the accessory 10 producing a cut of precise length with a radial arm saw. In the application shown, the elongated portion 62 of the stop rod 61 is inserted into the first stop retainer hole 51 and the edge of the transverse portion 63 is employed as a stop. FIG. 6 illustrates use of the accessory 10 to control the length of a cross-cut made with a table saw. In this application, the elongated portion 62 of the stop rod 61 is inserted into the second stop retainer hole 53 and the end of the transverse portion 63 is employed as a stop.

The accessory 10 can be used similarly to perform a variety of other functions with other machines including shapers, bandsaws, routers, drill-presses, jointers, spindle-shapers, etc. For example, when used with a long stop rod, the accessory 10 can control the cut off of work pieces which extend well beyond the end of a standard fence on tools such as portable mitre saws, free standing radial arm saws, and similar short fenced machines. Also, the accessory 10 can be used as a hold down device by mounting it on a fence of a table router, an over arm router, a spindle shaper or other similar machines and adjusting a stop rod to the thickness of the material being processed. Other desired applications of the accessory include its use as a cutting guide or short fence on a drill press by mounting it on the drill press table and adjusting a stop rod to an appropriate distance from the spindle line, or its use as a guide to control the vertical position of a board being edge sawed on a band saw by using a right angle stop rod and mounting the accessory 10 on the machine table. In addition, when used on a fence with a proper scale, the accessory 10 can be positioned to a selected length of cut off by positioning the edge of the first jaw 12 to the proper mark on the scale. This will work even on a high fence if a proper stop rod is used and saves the use of a separate pocket scale or similar measuring device and improves both speed and accuracy. Another use of the accessory 10 is on the fence of a jointer to control the position of the start of a cut when cutting repeat identical tapers. Still other uses of the accessory 10 for controlling the position of work pieces will occur to persons skilled in the fields of cabinet making, machining, model making, carpentry and other related fields of tool and machine operation.

Obviously, many modifications and variations of the present invention are possible in light of the above teachings. For example only, a variety of stop rod configurations other than that of the stop rod 61 specifically disclosed can be selectively and desirable utilized with the vice 11. In addition, in certain instances, the vice 11 can be effectively mounted directly on a work piece rather than on a machine. It is to be understood, therefore, that the invention can be practiced otherwise than as specifically described.

what is claimed:

1. A woodworking accessory comprising:

vice means including a first jaw means with an engagement surface for engaging one surface of a fence or the like, a second jaw means for engaging an opposite surface of the fence, a yoke means joining said first and second jaw means and adapted to extend over an edge of the fence extending between the opposite surfaces thereof, and adjustment means operable to produce relative movement between said first and second jaw means in a given direction substantially perpendicular to said engagement surface so as to produce selective forcible engagement of the fence between said first and second jaw means;

a first stop retainer means retained by said first jaw means, said first stop retainer means adapted to retain a stop member and guide movement thereof relative to said first jaw means in a first direction substantially perpendicular to said given direction; and a second stop retainer means retained by said first jaw means, said second stop retainer means adapted to retain a stop member and guide movement thereof relative to said first jaw means in a second direction substantially perpendicular to both said given direction and said first direction.

2. An accessory according to claim 1 including set means selectively operable to prevent movement of a stop member in either of said first or second stop retainer means.

3. An accessory according to claim 2 wherein said first stop retainer means comprises a first hole extending through said first jaw means and substantially parallel to said engagement surface, and said second stop retainer means comprises a second hole extending through said first jaw means and substantially parallel to said engagement surface.

4. An accessory according to claim 3 wherein said first hole intersects said second hole.

5. An accessory according to claim 4 wherein said set means comprises a threaded opening in said first jaw means and a set screw retained therein, said threaded opening extending substantially perpendicular to said engagement surface and intersecting both said first and second holes at the intersection thereof.

6. An accessory according to claim 5 wherein said first and second holes are cylindrical holes of equal diameter.

7. An accessory according to claim 6 including a stop rod member slidably receivable by said first and second holes.

8. An accessory according to claim 7 wherein said yoke comprises first and second spaced apart slide rods each having one end fixed to said first jaw means and a shank portion slidably received by openings in said second jaw means.

9. An accessory according to claim 8 wherein said adjustment means comprises a screw having one end fixed to said first jaw means and a body portion extending through an aperture in said second jaw means, and a nut received by an opposite end of said screw and movable into engagement with said second jaw means so as to produce said movement thereof relative to said first jaw means.

10. An accessory according to claim 9 wherein said screw is straddled by said first and second slide rods.

11. An accessory according to claim 9 wherein said screw extends slidably through an opening in said first jaw means and said adjustment means further comprises a handle with a cam portion fixed to said one end of said screw, and engageable with a surface of said first jaw means opposite to said engagement surfaces, said handle being operable to produce a predetermined limited degree of relative movement between said first and second jaw means.

12. An accessory according to claim 11 wherein said screw is straddled by said first and second slide rods.

13. An accessory according to claim 1 wherein said yoke comprises first and second spaced apart slide rods each having one end fixed to said first jaw means and a shank portion slidably received by openings in said second jaw means.

14. An accessory according to claim 13 wherein said adjustment means comprises a screw having one end fixed to said first jaw means and a body portion extending through an aperture in said second jaw means, and a nut received by an opposite end of said screw and movable into engagement with said second jaw means so as to produce said movement thereof relative to said first jaw means.

15. An accessory according to claim 14 wherein said screw is straddled by said first and second slide rods.

16. An accessory according to claim 14 wherein said screw extends slidably through an opening in said first jaw means and said adjustment means further comprises a handle with a cam portion fixed to said one end of said screw, and engageable with a surface of said first jaw means opposite to said engagement surfaces, said handle being operable to produce a predetermined limited degree of relative movement between said first and second jaw means.

17. An accessory according to claim 16 wherein said screw is straddled by said first and second slide rods.

18. An accessory according to claim 7 wherein said stop rod member is L-shaped.

* * * * *